US011852026B1

(12) United States Patent
Nicholson

(10) Patent No.: US 11,852,026 B1
(45) Date of Patent: Dec. 26, 2023

(54) EXO-BEARING FOR A TURBOMACHINE

(71) Applicant: Government of the United States, as represented by the Secretary of the Air Force, Wright-Patterson AFB, OH (US)

(72) Inventor: Brian Nicholson, Dayton, OH (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 0 days.

(21) Appl. No.: 18/095,559

(22) Filed: Jan. 11, 2023

Related U.S. Application Data

(60) Provisional application No. 63/310,171, filed on Feb. 15, 2022.

(51) Int. Cl.
*F01D 25/16* (2006.01)
*F01D 11/08* (2006.01)

(52) U.S. Cl.
CPC ..... *F01D 25/16* (2013.01); *F01D 11/08* (2013.01); *F05D 2240/307* (2013.01); *F05D 2240/50* (2013.01)

(58) Field of Classification Search
CPC .... F01D 25/16; F01D 11/08; F05D 2240/307; F05D 2240/50
See application file for complete search history.

(56) References Cited

U.S. PATENT DOCUMENTS

| | | | | |
|---|---|---|---|---|
| 2,870,847 | A * | 1/1959 | Fry | B64C 11/48 416/171 |
| 5,493,855 | A * | 2/1996 | Walters | F01D 5/3084 415/173.1 |
| 6,393,831 | B1 | 5/2002 | Chamis | |
| 7,055,303 | B2 | 6/2006 | Macfarlane et al. | |
| 7,926,291 | B1 | 4/2011 | Wilson, Jr. | |
| 9,453,516 | B2 * | 9/2016 | Kreitmair-Steck | B64C 27/82 |
| 2007/0039330 | A1 | 2/2007 | Bladon et al. | |
| 2014/0321968 | A1 * | 10/2014 | Kreitmair-Steck | F04D 29/326 415/228 |
| 2018/0209274 | A1 | 7/2018 | Zatorski et al. | |
| 2018/0230805 | A1 | 8/2018 | Miller et al. | |

FOREIGN PATENT DOCUMENTS

EP 1790833 A2 * 5/2007 ..... F01D 11/04

* cited by examiner

*Primary Examiner* — Eldon T Brockman
(74) *Attorney, Agent, or Firm* — AFMCLO/JAZ; Matthew D. Fair

(57) ABSTRACT

An exo-bearing system for a turbomachine is operable to improve aerodynamic efficiency and mechanical limits of rotor blades for fans, compressors, turbines, pumps and the like. The exo-bearing system is positioned between the tips of the blades and a surrounding structural housing. The exo-bearing system eliminates the air gap that is formed in prior art turbomachines and causes the blades to load in compression during operation which increases mechanical operability of the blades.

20 Claims, 11 Drawing Sheets

EXO-BEARING FOR A TURBOMACHINE

Pursuant to 37 C.F.R. § 1.78(a)(4), this application claims the benefit of and priority to prior filed Provisional Application Ser. No. 63/310,171, filed Feb. 15, 2022, which is expressly incorporated herein by reference.

RIGHTS OF THE GOVERNMENT

The invention described herein may be manufactured and used by or for the Government of the United States for all governmental purposes without the payment of any royalty.

TECHNICAL FIELD

The present disclosure generally relates to a turbomachine such as a gas turbine engine or the like and more particularly, but not exclusively to an exo-bearing positioned radially outward of the blade tips of a turbomachine rotor.

BACKGROUND

Conventional rotors for turbomachines have inherent design limitations that are exacerbated as the rotor speed increases in an effort to increase efficiency and performance. These inherent limitations include rotor burst, blade natural frequency, rotor dynamics, and blade tip aerodynamic losses.

Rotor stages are limited in speed due to material capability of the blades under tension. Expensive material alloys and manufacturing methods have been utilized to increase the structural capability of high speed turbomachinery. The length of the span between bearing locations lead to supercritical shaft operation, again restricting the design envelope or requiring complex damping mechanisms or additional bearing locations resulting in the detrimental addition of weight to the machine.

Rotor tip clearance between the rotor blades and the flowpath wall creates aerodynamic losses and thus reduces the efficiency of the machine. The tip clearance loss is a geometrically driven phenomena, as efficiency losses are magnified as engine size is reduced. This makes small and efficient turbine engines impractical. Existing systems have various shortcomings, drawbacks, and disadvantages relative to certain applications as described above, accordingly, there remains a need for further contributions in this area of technology.

SUMMARY

One embodiment of the present disclosure includes a unique bearing design for turbomachines and the like. Other embodiments include apparatuses, systems, devices, hardware, methods, and combinations wherein an exo-bearing system is located at the tip of the blades of a turbomachine rotor. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
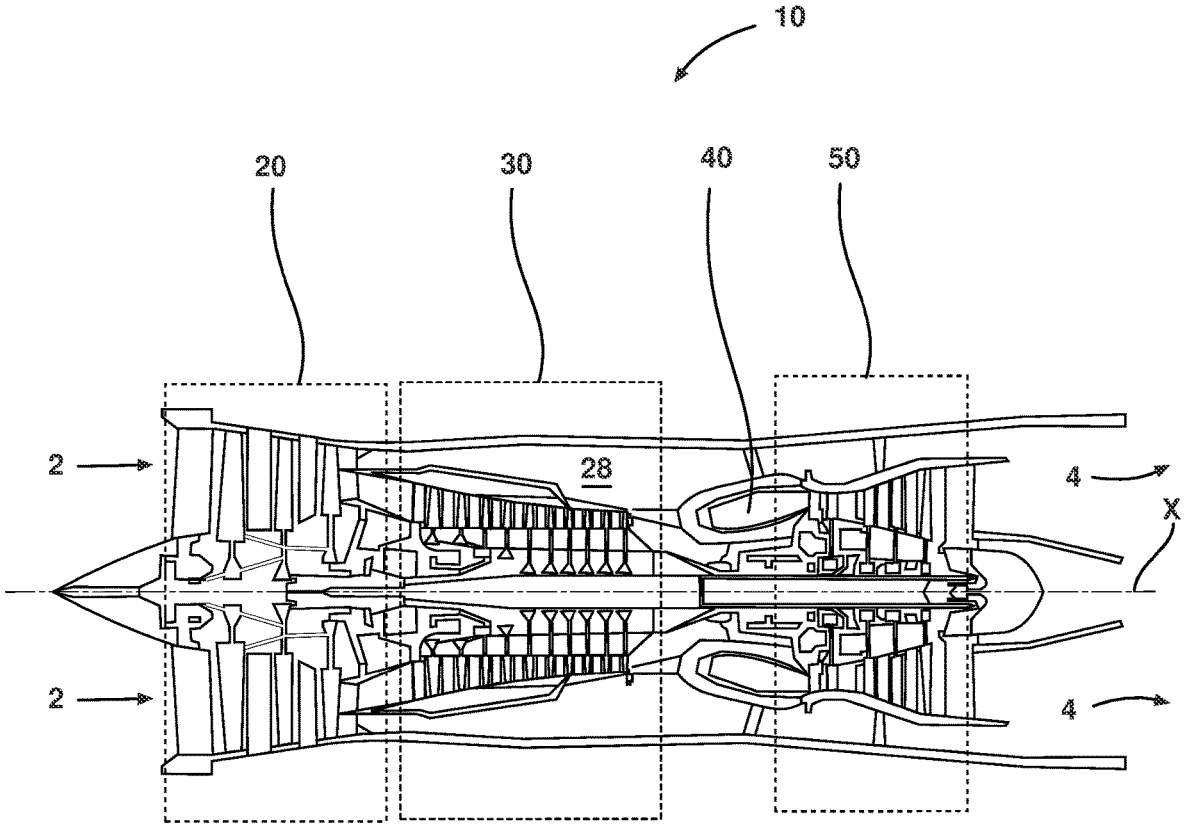
FIG. 1 (Prior Art)
FIG. 1 is a cross sectional view of a prior art turbomachine.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

The present invention defines a significant change in turbomachine architecture such as gas turbine engines, turbo-pumps, compressors, steam turbines and other axial flow machines with rotors having a gap between the tips of the airfoils or blades and the static structure encompassing the rotor. As opposed to traditional shaft mounted bearings, exo-bearings are located on the outer diameter of the turbomachinery blades or airfoils. The turbomachinery blades can include fan blades, compressor blades, turbine blades, fluid pumping blades and other types known to those skilled in the art. The exo-bearings can be of any type such as including without limitation air-bearings, fluid-film bearings, roller bearings, ball bearings, and sleeve bearings depending on the operating conditions and application.

In some forms, each rotor stage has an integral outer rim connected to the blade tips. In other forms, intermittent rotor stages have an integral outer rim connected to the blade tips (e.g., not every stage has an exo-bearing located at the blade tip. The outer surface of the outer rim can include a bearing surface. In other forms, that outer rim may have the bearing system attached thereto and a bearing surface is coupled to a static support structure radially outward of the rotor blades. Each rotor is supported from the outside, therefore the blade operating stress is in compression as opposed to tension in a traditional rotor. When the blades are operating under compression, significantly higher rotor speeds and reliability can be achieved as it removes the burst failure mode of the blades. Additionally, the elimination of tip clearances of the rotor blades will improve the aerodynamic efficiency of the engine. In some forms, an exo-bearing architecture may permit lubricant-free operation, leading to reduced weight and maintenance. Furthermore, this architecture enables novel flow path design which can result in major additional benefits related to size, cost, component life, performance, and/or efficiency.

The exo-bearing architecture is applicable to all turbomachines such as gas turbine engines, fluid pumps, fluid compressors, turbochargers, etc. The turbomachines can be used across commercial industries, including but not limited to, aviation, automotive, power generation, water treatment and supply, oil and gas, marine, refrigeration, and air handling applications.

Exo-bearing systems can mitigate or eliminate many of the drawbacks that traditional shaft installed bearing systems cause. First, the outer rim connected to the rotor stages at the blade tips reduce or eliminate rotor burst. By supporting the rotor on the outer diameter rather than the inner diameter, the stress pattern in the blades changes from tension to a compressive stress. Compression stresses can eliminate the burst failure mode and will result in the ability to use more cost effective materials or manufacturing processes. Second, the addition of the outer rim also increases the natural frequency of the blades. The analogous structure is transformed from a fixed-free or cantilevered beam to a fixed-fixed boundary condition. By increasing the natural frequencies, the blades are less likely to fail due to high cycle fatigue. Further, mechanical dampers can be eliminated when the natural frequencies are outside of operating machine frequencies. Third, rotor dynamic limitations are reduced with an exo-bearing system. By supporting each rotor stage independently, the rotor will behave as multiple stub shafts as opposed to a long span shaft. This effectively removes the shaft bending critical speed and all of its derivatives. The shaft is only required to transfer torque and may be designed such that it does not provide transverse rotor excitation, such as stinger shafting or a spline coupled shafting. Finally, the addition of the outer rim completely removes the clearance issue as the outer wall of the flow path is now directly connected to the end of the blade. Proper sealing strategies and bearing selection will limit or eliminate leakage from the additional outer flow path wall discontinuities generated by the outer diameter bearings.

Referring now to FIG. 1, a cross-sectional view of a prior art turbomachine 10 in the form of gas turbine engine is illustrated. The turbomachine includes a fan section 20 operable for compressing ambient air entering through an inlet 2 and transporting a portion of the air to a compressor section 30 and the remainder through a bypass duct 28. The compressor section 30 further compresses the air to a higher pressure prior to entry into a combustor 40. The combustor 40 burns a fuel in the pressurized air to produce a high temperature combustion gas that rotationally drives a turbine in a turbine section 50. The fan, compressor and turbine rotors rotate about a centerline axis X of the gas turbine engine 10. The exhaust flow 4 exits the gas turbine engine 10 at a high velocity to generate thrust as is known to those skilled in the art.

Figure 2:
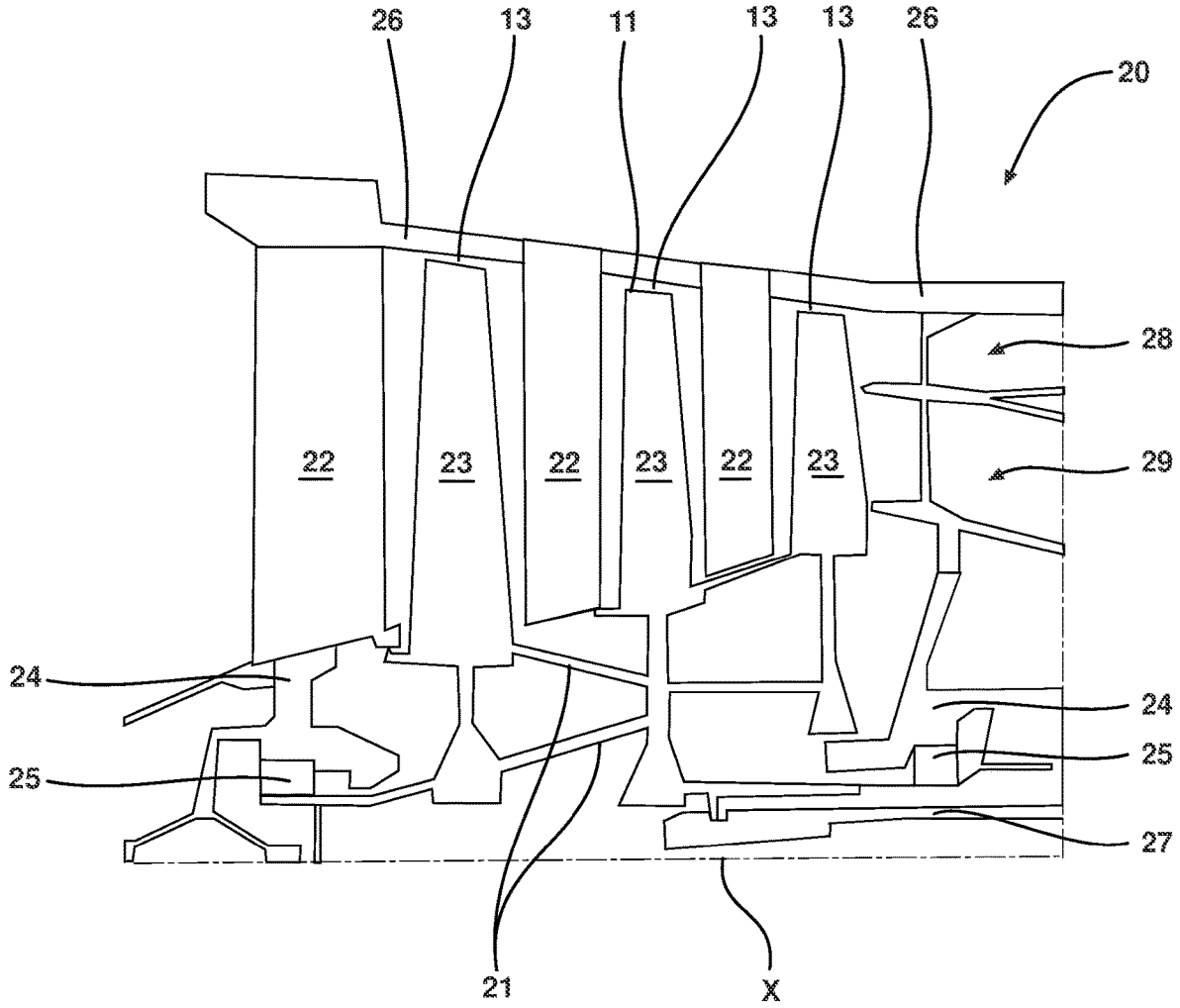
FIG. 2 (Prior Art)
FIG. 2 is a cross sectional view of a fan section of the turbomachine illustrated in FIG. 1.

Referring to FIG. 2, cross section view of the fan section 20 is depicted. The fan section 20 includes a plurality of stator vanes 22 and a plurality of rotatable fan blades 23 positioned adjacent one another. Ambient air passes through the fan section and is compressed to a higher pressure. A portion of the airflow exiting the fan section 20 is directed to a core pathway 29 and the remainder passes through a bypass pathway 28. The plurality of fan blade stages 23 are connected together through fan rotor arms 21. One or more bearing compartments 24 are configured to house a bearing assembly 25 than includes ball bearings or roller bearings or the like to rotatably support the fan rotor. The bearing assembly is located radially inward of the blades 23 toward the centerline axis of rotation X.

An air gap 13 is formed between tips 11 of the blades 23 and a fan case 26. The gap 13 generates aerodynamic losses and inefficiency in the turbomachine and permits the blade to expand radially outward at high rotational speeds which can lead to structural failure of the blade during operation. A fan shaft 27 is coupled to a turbine (not shown) that is configured to drive the fan rotor to operating speeds which may range between several hundred RPMs to several thousand RPMs.

Figure 3:
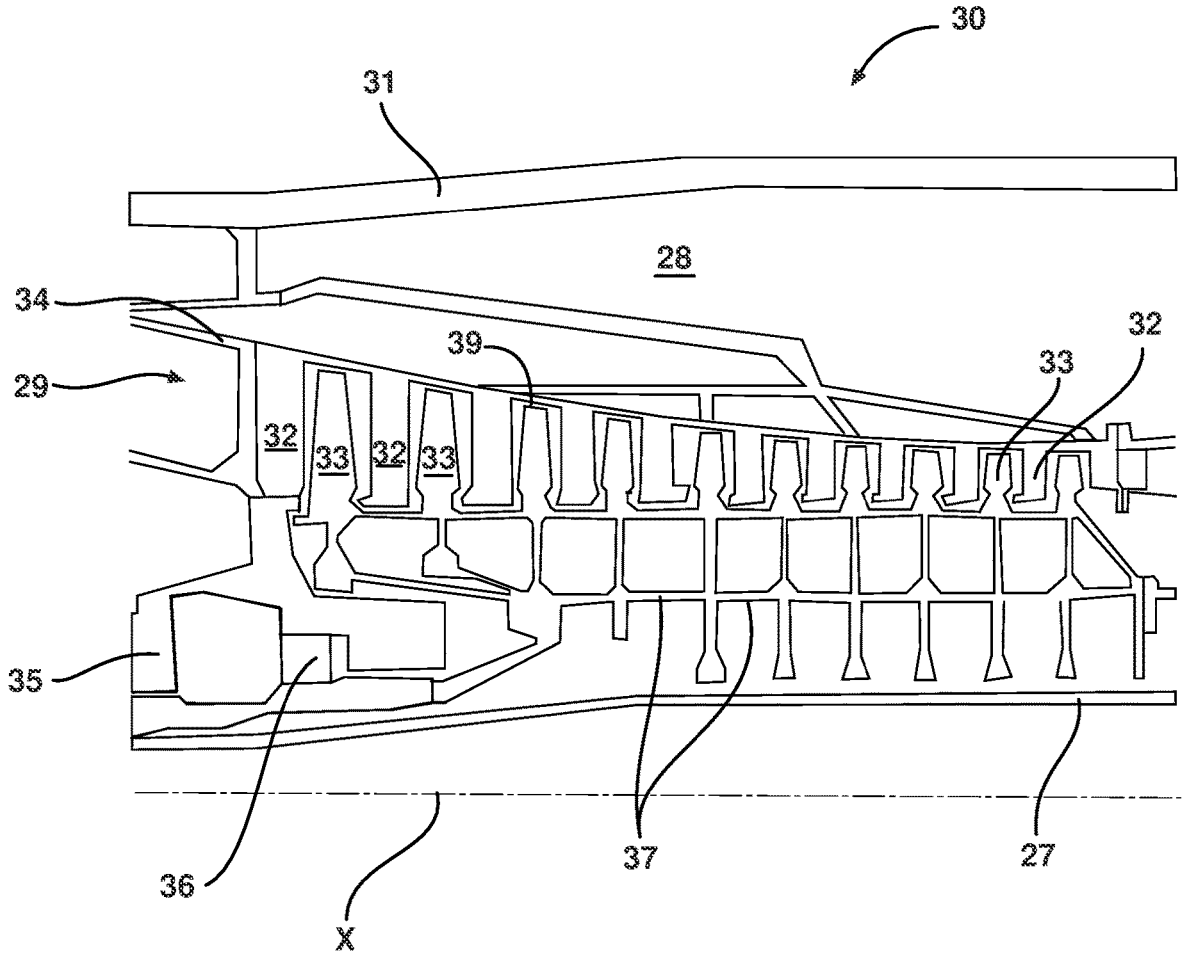
FIG. 3 (Prior Art)
FIG. 3 is a cross sectional view of a compressor section of the turbomachine illustrated in FIG. 1.

Referring now to FIG. 3, cross section view of the compressor section 30 is depicted. The compressor section 30 includes a plurality of stator vanes 32 and a plurality of rotor stages having compressor blades 33 positioned adjacent one another. A compressor case 34 surrounds the vanes 32 and rotor blades 33. A bypass case 31 forms a bypass duct 28 around the compressor section 30 to permit bypass airflow to traverse therethrough. The pressurized air exiting through the fan core passageway 29 enters the compressor section 30 and is further compressed to a specified operating pressure. The compressor rotor stages are connected together via compressor rotor arms 37. One or more bearing compartments 35 are configured to house a bearing assembly 36 that may have ball bearings or roller bearings or the like to rotatably support the compressor rotor. The bearing assembly 36 is located radially inward of the blades 33 between the core flow path 29 and the centerline axis of rotation X. An air gap 39 is formed between blade tips and the compressor case 34. Similar to the fan section 20 the gaps 39 at the tips of each compressor rotor blade 33 causes aerodynamic losses through the turbomachinery and permits the blades 33 to expand radially outward at high rotational speeds which can lead to structural failure of the blade during operation. A compressor shaft (not shown) is coupled to a turbine (also not shown) to drive the compressor rotor to operating speeds that may range between several thousand RPMs to a hundred thousand RPMs or greater.

Figure 4:
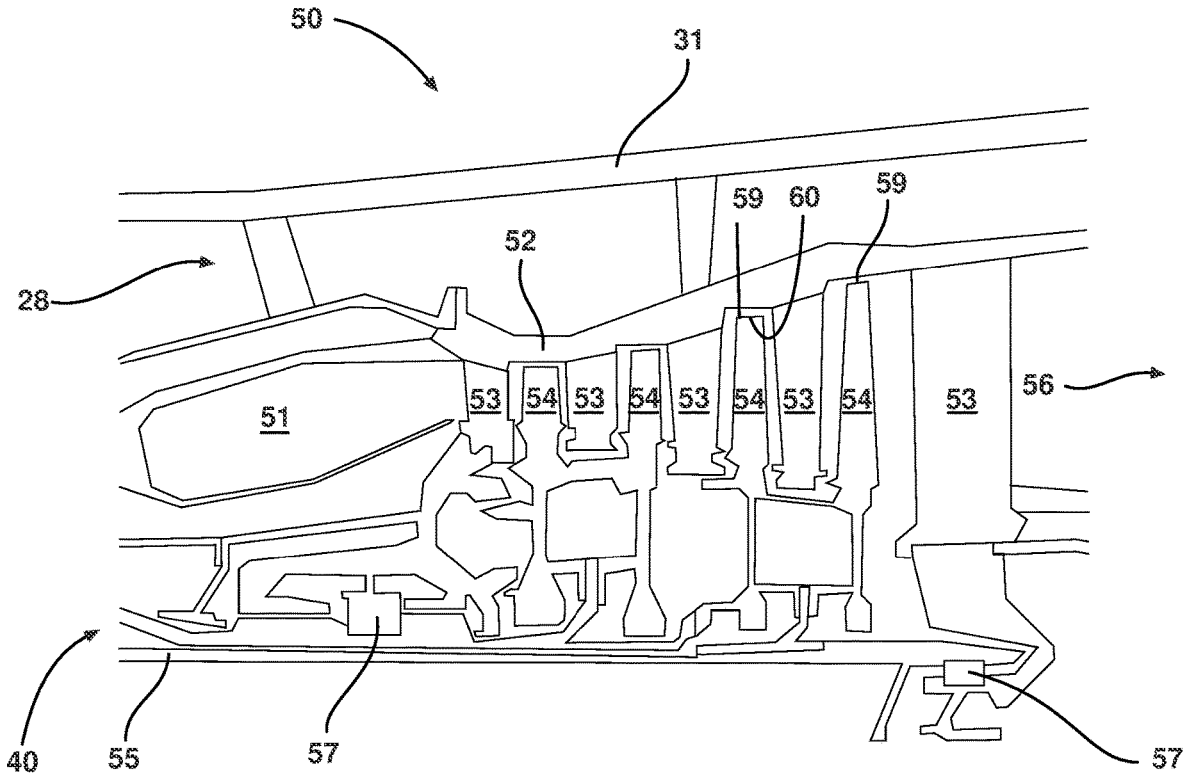
FIG. 4 (Prior Art)
FIG. 4 is a cross sectional view of a turbine section of the turbomachine illustrated in FIG. 1.

Referring now to FIG. 4, cross section view of the combustor section 40 and turbine section 50 is depicted. The combustor section 40 includes a combustor 51 that is operable for burning a fuel with the pressurized air exiting the compressor section 30. The high temperature combustion gases are directed to the turbine section 50 where the turbine rotors are driven to operational speeds required to mechanically drive the compressor rotor and fan rotor through one or more turbine shafts 55 that are connected to the fan shaft (not shown) and the compressor shaft (not shown). The turbine section 50 includes a plurality of stator vanes 53 and a plurality of rotors having turbine blades 54 positioned adjacent one another. A turbine case 52 surrounds the turbine vanes 53 and turbine blades 54. The bypass case 31 and bypass duct 28 permit bypass airflow to traverse past the combustor 51 and turbine section 50 and exit through a bypass exhaust nozzle (not shown) to produce a thrust force. The high temperature combustion gasses exiting through the turbine exit flowpath 56 and then accelerates through a core nozzle (not shown) to produce additional thrust force. One or more turbine bearing assemblies 57 are configured to rotatably support the turbine rotor. The turbine bearing assembly 57 is located radially inward of the blades 54 between the turbine flow path 56 and the centerline axis of rotation X (not shown in this view). An air gap 59 is formed between the tips 60 of the turbine blades 54 and the turbine case 52 to ensure that the tips 60 do not rub the turbine case during operation. Similar to the fan section 20 and the compressor section 30, the turbine tip gaps 59 cause aerodynamic losses through the turbomachinery and permits the blade to expand radially outward at high rotational speeds which can lead to structural failure of the blade during operation. A compressor shaft (not shown) is coupled to a turbine (also not shown) to drive the compressor rotor to operating speeds that may range between several thousand RPMs to a hundred thousand RPMs or greater.

Figure 5:
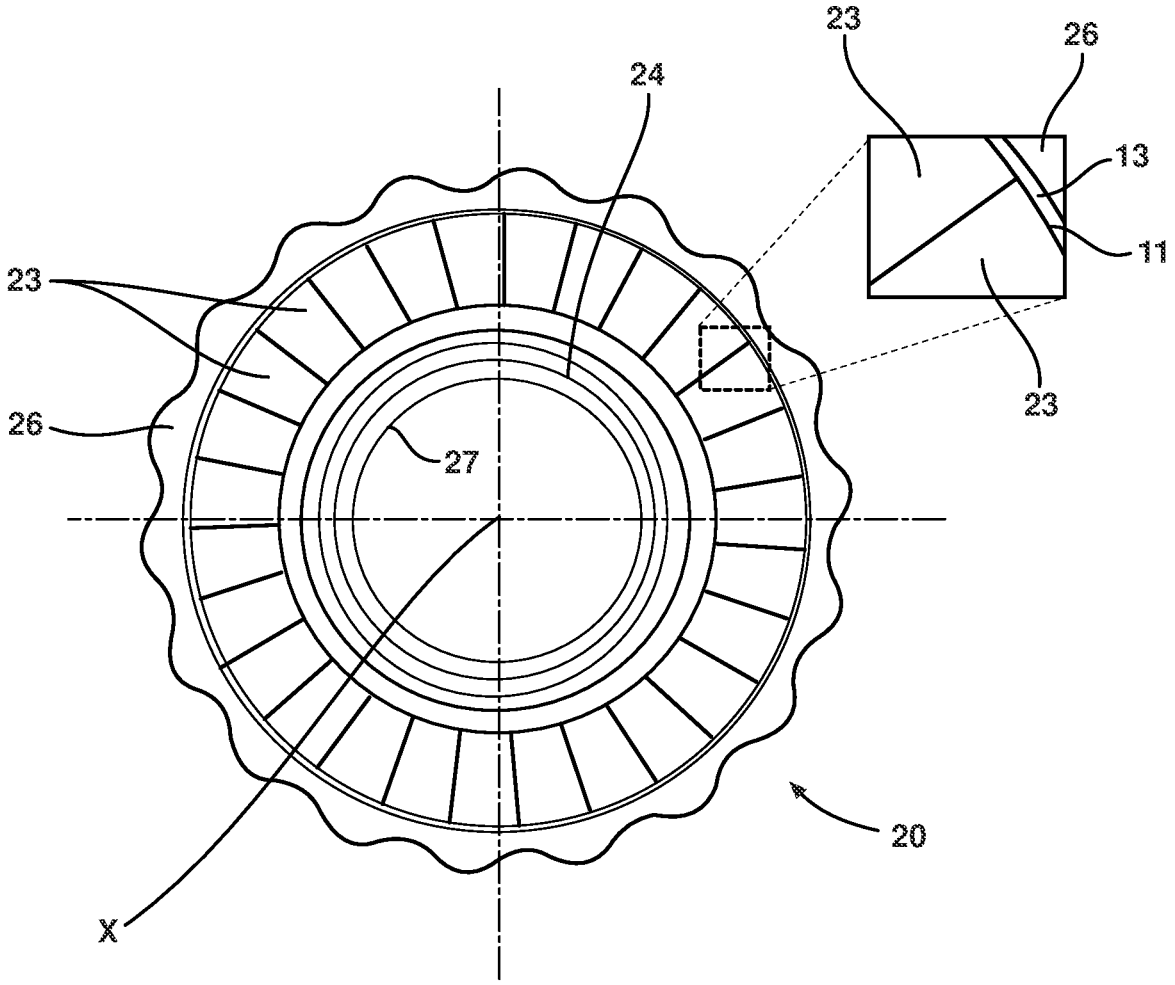
FIG. 5 (Prior Art)
FIG. 5 is an end view of a fan section of the turbomachine illustrated in FIG. 1.

FIG. 5 is an end view of the fan section 20 that more clearly shows a gap 13 positioned between the blade tip 11 of the fan blades 23 and the inner wall of the fan case 26. The gap 13 extends around the fan rotor such that the fan blades 23 can rotate about the axis X of rotation without rubbing the inner wall of the fan case 26. This end view is similar for both the compressor section 30 and the turbine section 50 and are not shown due to redundancy.

Figure 6:
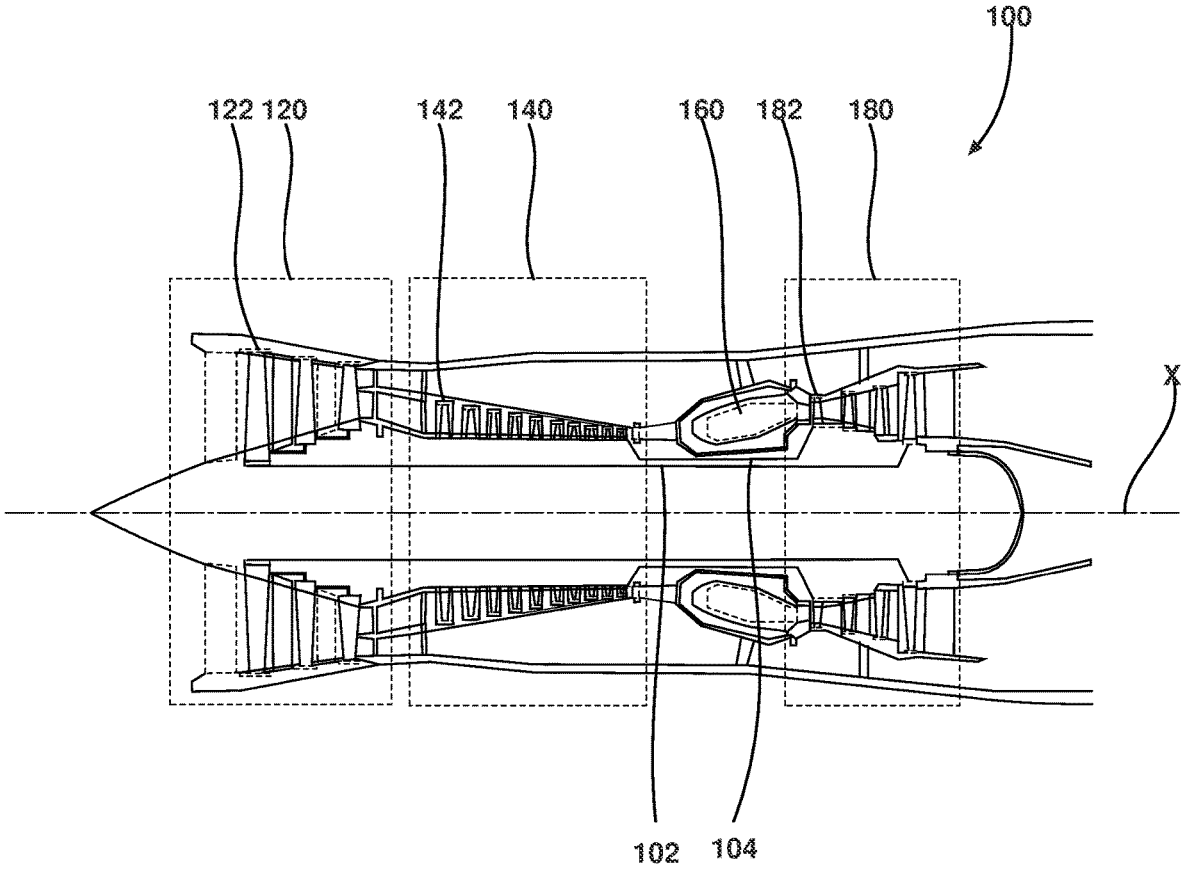
FIG. 6 is a cross sectional view of a turbomachine according to one embodiment of the present invention.

FIG. 6 is a cross sectional view of an exemplary turbomachine 100 according to one embodiment of the present disclosure. While the exemplary embodiment is shown as a gas turbine engine, it should be understood that the inventive teachings of the present disclosure may be used to improve the efficiency and mechanical properties of any turbomachine with rotating blades. These machines can include, but are not limited to turbo-pumps, steam turbines, gas compressors and the like. The gas turbine engine 100 includes a fan section 120, compressor section 140, a combustor 160, and a turbine section 180. A fan shaft 102 mechanically connects a portion of the turbine section 180 typically called a low pressure turbine stage to the fan section 120. A compressor shaft 104 mechanically connects a portion of the turbine section 180 typically called a high pressure turbine stage to the compressor section 140. The fan, compressor and turbine sections 120, 140, 180 rotate about the centerline axis of rotation X. General operation of the gas turbine engine 100 is similar to that described in FIG. 1, with the exception of the novel exo-bearing system. The fan exo-bearing system 122, the compressor exo-bearing system 142 and the turbine exo-bearing system 182 are configured to permit centripetal loading from the rotors to be passed through the blades to the structural cases surrounding the rotors. The exo-bearings 122, 142, 182 are positioned between the tips of the blades of the fan 120, compressor 140 and turbine 180, respectively and the static case structure encompassing the rotors. The exo-bearings 122, 142, 182 are configured to eliminate the gap that is formed between the blade tips and the cases in prior art turbomachines. Further, the exo-bearings permit the blades to be loaded in compression as they grow radially outward during operation. The compression loading of the blades mitigates or eliminates mechanical failure due to high frequency vibration and high cycle fatigue dynamics.

Figure 7:
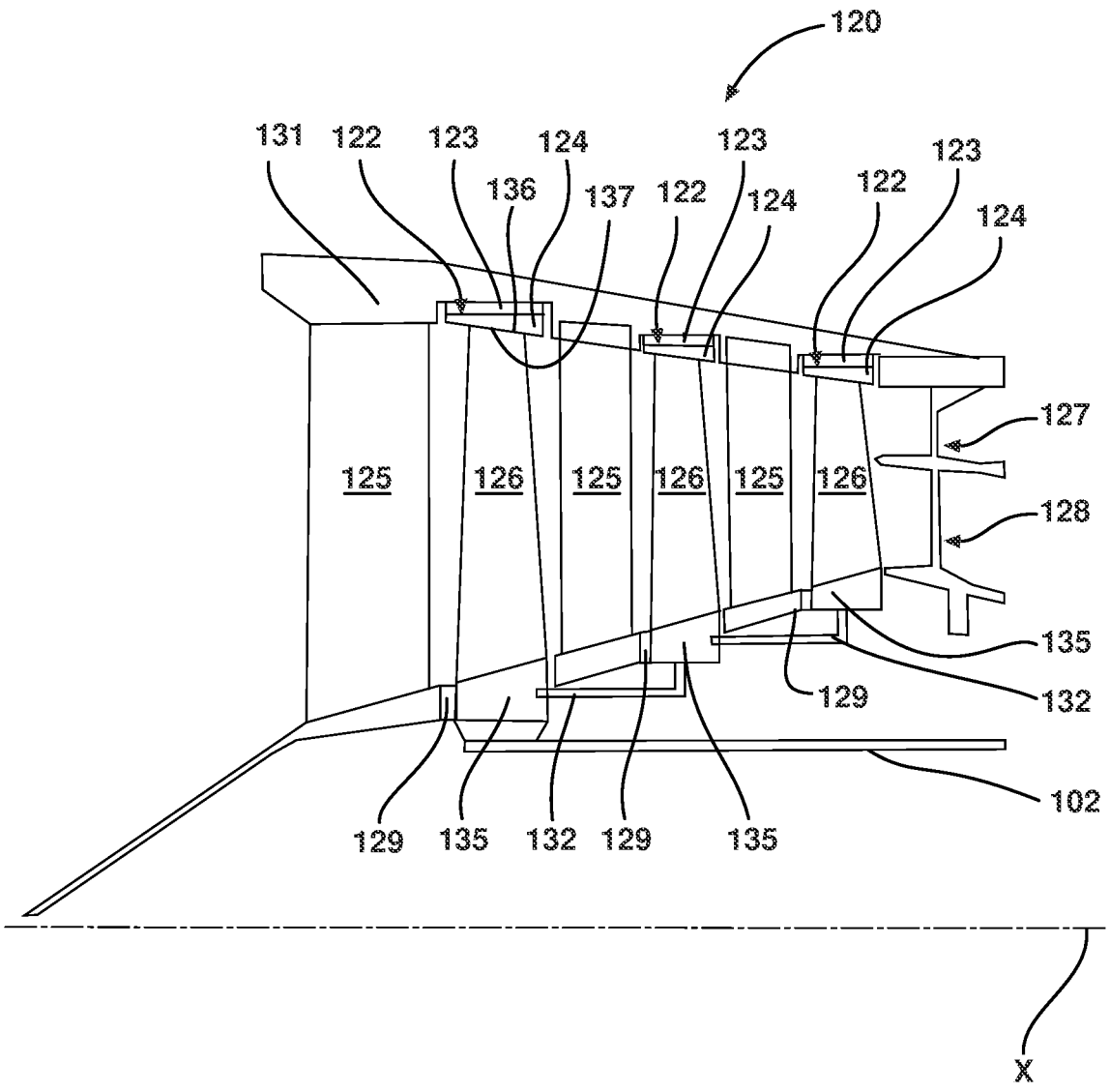
FIG. 7 is a cross sectional view of a fan section of the turbomachine illustrated in FIG. 6.

Referring now to FIG. 7, the fan section 120 is shown with additional detail. A fan case 131 provides static structural support enveloping one or more stator vane stages 125 and one or more fan blade stages 126. Typically, rotor stages and stator stages are positioned intermittently adjacent one another, but may take different forms in alternate embodiments. Each blade 126 extends radially outward from a hub 135 to a tip 136. A fan exo-bearing 122 is positioned proximate the tip 136 of the rotatable blades 126. The exo-bearing 122 can be configured and designed in multiple ways. In one form, the exo-bearing 122 includes an outer race 123 and an inner race 124. The inner race 124 is coupled to the blades 126 and the outer race 123 is coupled to a fixed structure such as the fan case 131. In one form, the inner race can be a circular ring or rim that is connected to all of the blades 126 in each stage. The outer race 123 can include a bearing assembly that is configured to engage the inner race 124 and receive the radial loads generated by the fan rotor during operation. In another form the inner race can include a plurality of separate discreet rim segments such that a rim segment is connected to each blade 126 at the tips 136. In yet another embodiment, the inner race 124 may include the bearings and the outer race 123 may include a static rim or other mating structure connected to the fan case 131 for the exo-bearing system to engage therewith.

The bearings for the exo-bearing system 122 for the fan (and other locations in the engine) can be of any type that a skilled artisan determines to be effective for a particular application. The bearing systems can include, but are not limited to roller bearings, ball bearings, sleeve bearings, air bearings, electro-magnetic bearings or the like. The inner race 124 of the exo-bearing system 122 includes a housing with an inner wall 137 that includes a contour shape that defines a portion of an outer flow path wall through the fan section 120. The inner wall 137 may be angled relative to the centerline axis X for some embodiments. In yet other embodiments the inner wall 137 of the inner race 124 may be contoured with arcuate or curved surface portions. The rotor stages are connected together via rotor support arms 132 that extend from the hubs 135 of the blades 126. A thrust bearing 129 can be positioned on a forward face, aft face or on both faces of the rotor blades 126 proximate the hubs 135 thereof. The thrust bearing(s) take the thrust loading generated by the rotor and transmits the loading through the stators 125 and then out to the fan case 131.

Figure 8:
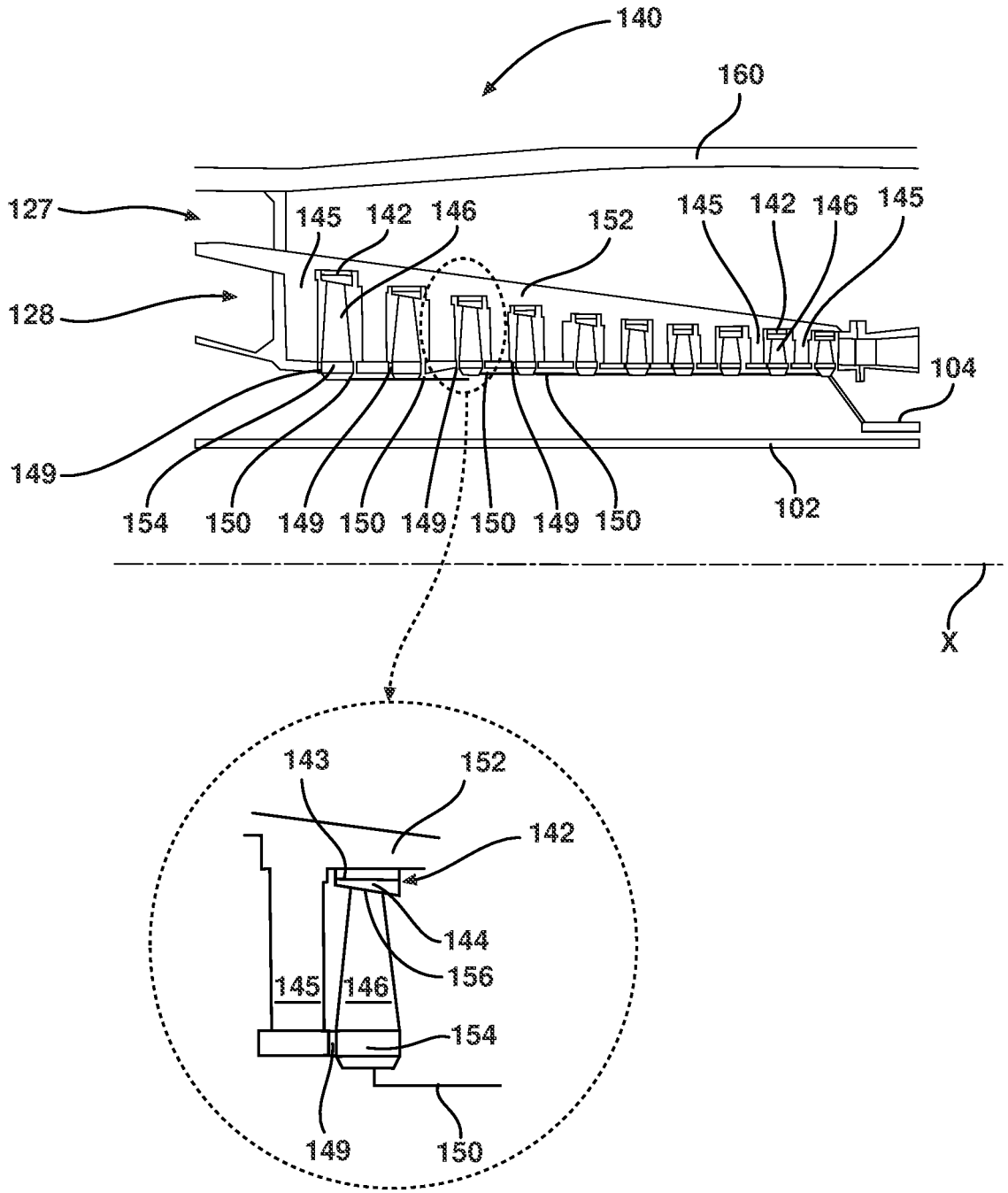
FIG. 8 is a cross sectional view of a compressor section of the turbomachine illustrated in FIG. 6.

Referring now to FIG. 8, the compressor section 140 is shown with additional detail. The compression section 140 includes similar design features to that of the fan section 120 discussed above. A compressor case 152 provides static structural support enveloping one or more stator compressor vane stages 145 and one or more compressor blade stages 146. Each compressor blade 146 extends radially outward from a hub 154 to a tip 156. A compressor exo-bearing 142 is positioned proximate the tip 156 of each of the rotatable compressor blades 146. The compressor exo-bearing system 142 can be configured and designed in multiple ways similar to the fan exo-bearing system 122 and will not be described in the same detail again. In the disclosed embodiment, the compressor exo-bearing 142 includes an outer race 143 and an inner race 144. The inner race 144 is coupled to the blades 146 and the outer race 143 is coupled to a fixed structure such as the compressor case 152. The inner race 144 can be a circular ring or rim that is connected to the tips 156 of each blade 146 of a rotor stage. The outer race 143 can include a bearing assembly that is configured to engage the inner race 144 and receive the radial loads generated by the rotor during operation. In another form, the inner race 144 can include a discreet rim connected to each blade 146 at the tips 156. In yet another embodiment, the inner race 144 may include the bearings and the outer race 143 may include a static rim or other mating structure connected to the compressor case 152 for the compressor exo-bearing system to engage therewith.

The bypass pathway 127 extends through the bypass duct 160 to permit the bypass flow to move past the compressor section 140 without being further pressurized through the compressor turbomachinery. The core pathway 128 directs pressurized flow from the fan section 120 through the compressor 140 which further pressurizes the air prior to entering the combustor 160. The fan shaft 102 extends from the fan section 120 past the compressor section 140 and is connected to the turbine section 180 (not shown in FIG. 8). The compressor shaft 104 extends from the compressor section 140 and is connected to the turbine section 180. The compressor rotor stages are connected together via rotor support arms or connecting shafts 150 that extend from the hubs 154 of adjacent compressor blades 146. A thrust bearing 149 can be positioned on a forward face, aft face or on both faces of the rotor blades 146 proximate the hubs 154 thereof. The thrust bearing(s) 149 take the thrust loading generated by the compressor rotor and transmits that loading through the stators 145 and then out through the compressor case 152.

Figure 9:
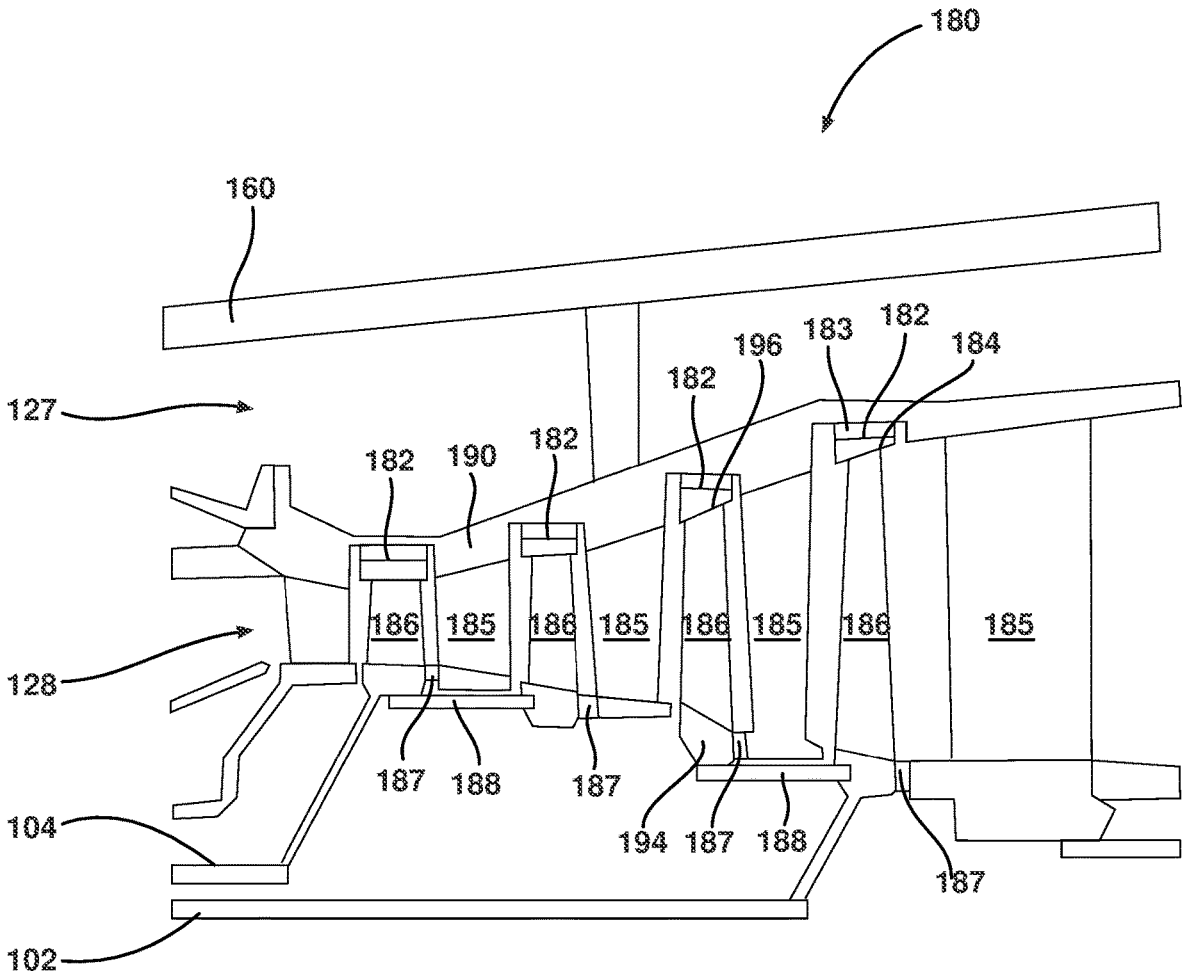
FIG. 9 is a cross sectional view of a turbine section of the turbomachine illustrated in FIG. 6.

Referring now to FIG. 9, the turbine section 180 is shown with additional detail. The turbine section 180 includes similar design features to that of the fan section 120 and the compressor section 140 discussed above. A turbine case 190 provides static structural support enveloping one or more stator turbine vane stages 185 and one or more turbine blade stages 186. Each turbine blade 186 extends radially outward from a hub 194 to a tip 196. A turbine exo-bearing 182 is positioned proximate the tip 196 of each of the rotatable turbine blades 186. The turbine exo-bearing system 182 can be configured and designed in multiple ways similar to the fan exo-bearing system 122 and the compressor exo-bearing system 142. In the disclosed embodiment, the turbine exo-bearing 182 includes an outer race 183 and an inner race 184. The inner race 184 is coupled to the turbine blades 186 and the outer race 183 is coupled to a fixed structure such as the turbine case 190. The inner race 184 can be a circular ring or rim that is connected to the tips 196 of each turbine blade 186 of a rotor stage. The outer race 183 can include a bearing assembly that is configured to engage the inner race 184 and receive the radial loads generated by the rotor during operation. In another form, the inner race 184 can include discreet rim segments connected to each blade 186 at the tips 196. In yet another embodiment, the inner race 184 may include the bearings and the outer race 183 may include a static rim or other mating structure connected to the turbine case 190 for the turbine exo-bearing system 182 to engage therewith.

The bypass pathway 127 extends through the bypass duct 160 to permit the bypass flow to move past the turbine section 140 and accelerates through a bypass nozzle (not show) to produce a thrust force. The core pathway 128 directs high temperature combustion gases from the combustor 160 (see FIG. 1) to the turbine 180 where work is extracted from the exhaust gases which drives the turbine to a high rotational speed. The turbine 180 drives the fan 120 and the compressor 140 through the fan shaft 102 and the compressor shaft 104, respectively. The turbine rotor stages are connected together via rotor support arms or connecting shafts 188 that extend between the hubs 194 of adjacent turbine blades 186. A thrust bearing 187 can be positioned on a forward face, aft face or on both faces of the rotor turbine rotor blades 186 proximate the hubs 194 thereof. The thrust bearing(s) 187 take the thrust loading generated by the turbine rotor and transmits that loading through the stators 186 and then out through the turbine case 190.

Figure 10:
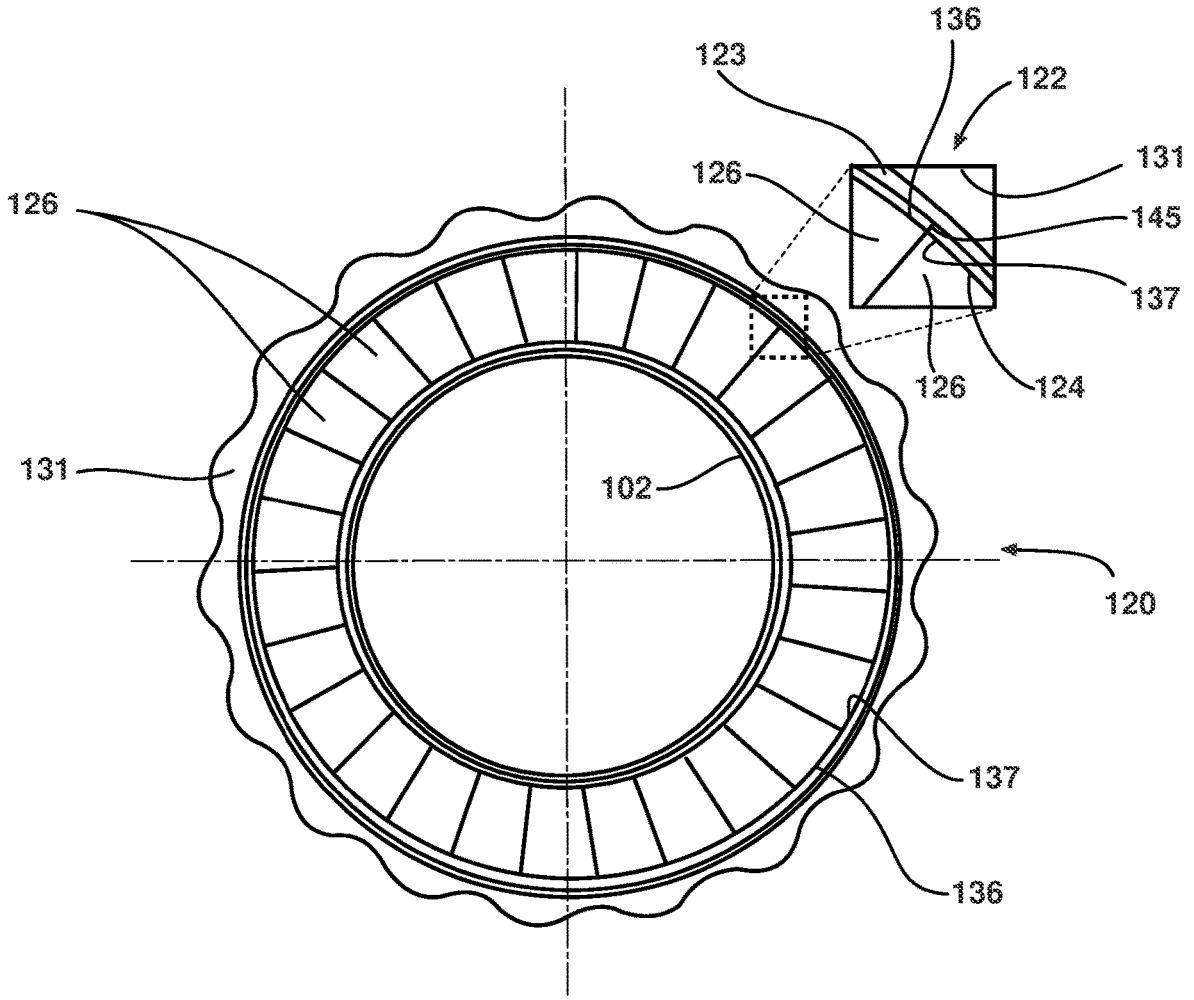
FIG. 10 is an end view of a fan section of the turbomachine illustrated in FIG. 6.

FIG. 10 is an end view of the fan section 120 that more clearly shows the exo-bearing 122 positioned between the blade tip 136 of the fan blades 126 and the inner wall of the fan case 131. The exo-bearing 122 extends around the fan rotor such that the fan blades 126 can rotate about the axis X of rotation without a gap formed between the tips 136 of the fan blades 126 and the inner wall of the fan case 131. The inner wall 137 of the inner race 124 is contoured to the desired shape of the air flow path boundary through the fan section 120. In some optional embodiments the inner race 124 may include a plurality of spaces or slits 145 that separate the 360 degree ring into a plurality of segmented portions positioned at a tip 136 of each of the plurality of blades 126. This end view is similar for both the compressor section 120 and the turbine section 180 because the exo-bearing design is substantially similar in various turbomachinery applications.

Figure 11:
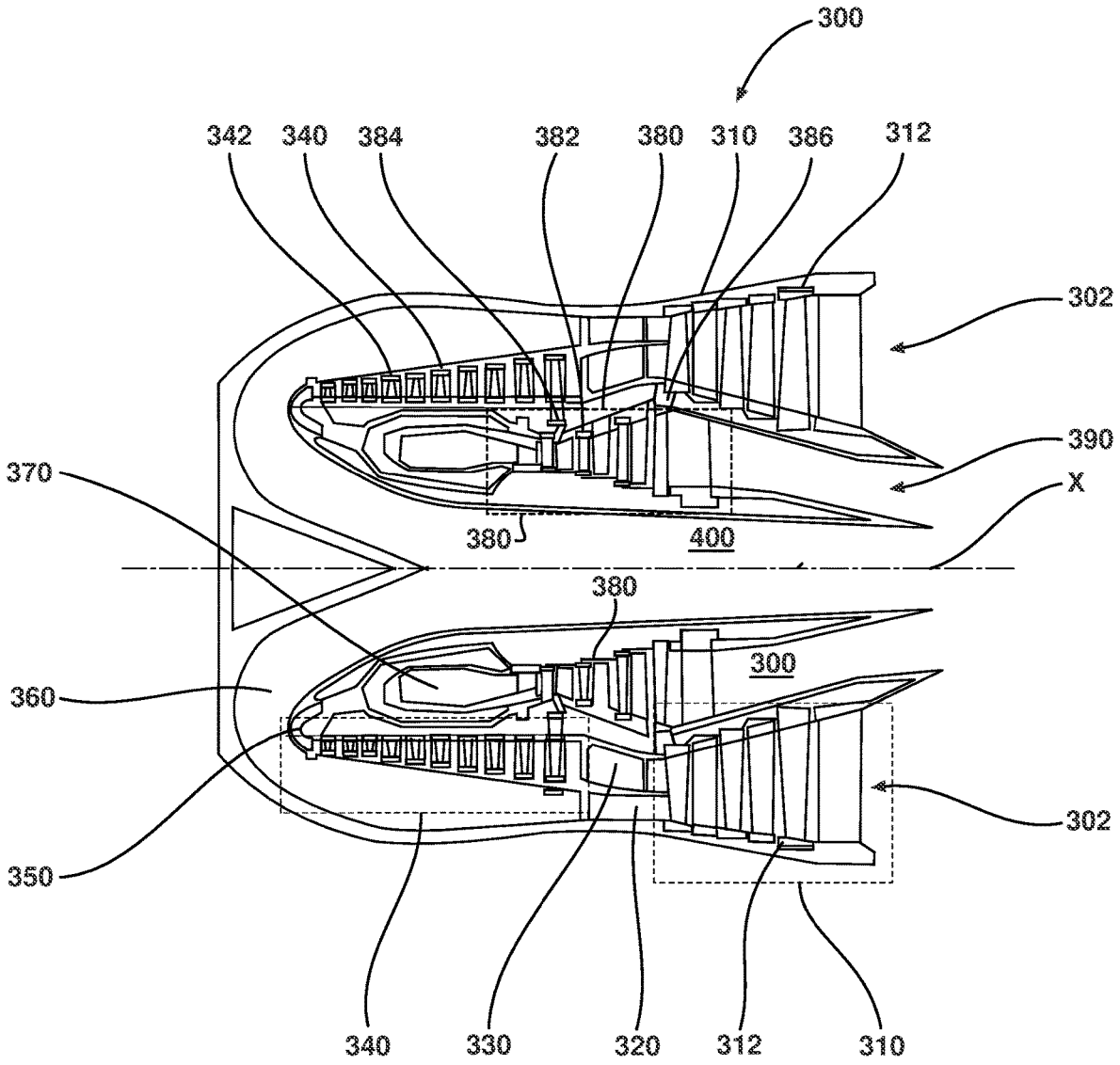
FIG. 11 is a cross sectional view of a turbomachine according to another embodiment of the present invention.

Referring now to FIG. 11, an alternate configuration for a turbomachine 300 is made possible by the use of an exo-bearing system. The turbomachine 300 is in a form of a compact reverse flow path configuration where the combustor and turbine are positioned radially inward of the fan and the compressor relative to the axis of rotation X. Most if not all of the features associated with the embodiment shown in FIGS. 6-10 are applicable to this embodiment and will not be reiterated here. Although not shown, in another embodiment, the combustor may be located at substantially the same radial position relative to the axis of rotation X as the compressor and the fan. The turbomachine includes an inlet 302 to direct ambient air into the fan 310. The fan rotates about the axis X of rotation and is rotationally supported by a fan exo-bearing system 312. The fan exo-bearing system 312 is defined in the same manner as those embodiments described in FIGS. 6-10 and will not be reiterated in this embodiment. After the fan compresses the ambient air, a portion of the air flows through the bypass pathway 320 and the remainder flows through the core pathway 330. The bypass pathway 320 traverses in a substantially longitudinal or axial direction defined by the axis of rotation until a bypass reversal path 360 turns the flow radially inward and reverses the direction approximately 180 degrees. The bypass flow then accelerates through a bypass exhaust nozzle 400 and provides a thrust component for the turbomachine 300.

The core pathway 330 directs the core air to the compressor 340 where it is further compressed to a desired pressure. A compressor exo-bearing system 342 rotatably supports the compressor 340 in high speed rotation. The compressed air then flows through a core reversal path 350 and makes approximately a 180 degree turn radially inward prior to entering the combustor 370. A fuel-air mixture is combusted to produce a high temperature exhaust gas that drives the turbine 380 into high speed rotation. A turbine exo-bearing system 382 rotatably supports the turbine 380 in high speed rotation.

The exo-bearing systems 312, 342, and 382 include thrust bearings positioned adjacent the hub of the blades as described previously. A compressor-turbine gear shaft 384 connects the compressor 340 to the turbine 380 such that as the turbine 380 rotates the compressor 340 is rotationally driven. A fan-turbine gear shaft 386 connects the fan 310 to the turbine 380 such that as the turbine 380 rotates the fan 310 is rotationally driven.

In one aspect the present disclosure includes a turbomachine comprising: a housing; a rotor having a shaft extending through the housing of the turbomachine; at least one rotor stage of blades extending radially outward from the shaft; wherein each blade extends from a hub to a tip; and an exo-bearing system operably connected to the blades proximate the tips thereof.

In refining aspects, the exo-bearing system is operable with at least one stage of blades in a fan section, a compressor section, and/or a turbine section of the turbomachine; the exo-bearing system includes an outer race coupled to the housing and an inner race coupled to the outer race and to the tips of the blades; the inner race includes a rim formed into a 360 degree ring; the inner race includes a rim segment connected to each blade tip; the outer race includes a bearing assembly configured to receive radial loading from the blades as the rotor rotates about the axis of rotation; the inner race includes a bearing assembly and the outer race include a fixed bearing surface coupled to the housing; the exo-bearing system includes at least one of a roller bearing, ball bearing, air bearing, sleeve bearing and/or film bearing; a thrust bearing positioned adjacent the hub of a plurality of blades; wherein the thrust bearing engages a static portion of the turbomachine when the rotor moves in an axial direction during operation; wherein the housing surrounds at least one of a fan section, a compressor section and a turbine section; wherein the exo-bearing engages between the compressor housing and the rotor tip in the fan section, the compressor section and/or the turbine section; wherein the bearing system includes an exo-bearing engaged between the compressor housing and the rotor tip of each turbine rotor stage; and an exo-bearing positioned at the tips of the blades at each stage of a rotor section.

In another aspect, a system comprises: a turbomachine; at least one rotor having a plurality of aerodynamic blades extending from a hub to a tip; a static structure positioned around the at least one rotor; and an exo-bearing system positioned between the tips of the blades and the static structure.

In refining aspects, the exo-bearing includes an inner race and an outer race; the outer race includes a bearing assembly fixed to the outer structure and movably engageable with the inner race; the inner race is coupled to the tips of the blades; wherein the inner race is a 360 degree rim having a bearing surface that is rotatable with the blades; wherein the inner race includes a bearing assembly connected to the tips of the blades that moveably engages the outer race as the rotor rotates during operation.

In another aspect, the present disclosure includes a method comprising: positioning an exo-bearing system between a plurality of blades on a rotor in a turbomachine and a surrounding static structure; rotating the rotor to an operational speed; and loading the plurality of blades in compression at the operational speed.

In another aspect, the present disclosure includes a turbomachine comprising: an axis of rotation; a fan section extending in a longitudinal direction along the axis of rotation; a compressor section positioned downstream of the fan section in the same longitudinal direction as the fan section; a core reversal pathway positioned downstream of the compressor section, the core reversal pathway configured to turn the core path radially inward and back to an opposite direction of the longitudinal direction; a combustor positioned downstream and radially inward of the compressor; a turbine section positioned downstream of the combustor and radially inward of the fan section; and an exo-bearing system operable with the fan section, the compressor section and the turbine section.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A turbomachine comprising:

a housing;

a rotor having a shaft extending through the housing of the turbomachine;

at least one rotor stage having a plurality of blades extending radially outward from the shaft;

wherein each blade extends from a hub to a tip;

an exo-bearing system operably connected to the tip of each of the plurality of blades; and wherein the exo-bearing system includes an outer race coupled to the housing and an inner race coupled between the outer race and the tips of the blades.

2. The turbomachine of claim 1, wherein the exo-bearing system is operable with at least one stage of blades in a fan section, a compressor section, and/or a turbine section of the turbomachine.

3. The turbomachine of claim 1, wherein the inner race includes a rim formed into a 360 degree ring.

4. The turbomachine of claim 1, wherein the inner race includes a rim segment connected to each blade tip.

5. The turbomachine of claim 1, wherein the outer race includes a bearing assembly configured to receive radial loading from the blades as the rotor rotates about the axis of rotation.

6. The turbomachine of claim 1, wherein the inner race includes a bearing assembly and the outer race include a fixed bearing surface coupled to the housing.

7. The turbomachine of claim 1, wherein the exo-bearing system includes at least one of a roller bearing, ball bearing, air bearing, sleeve bearing and/or film bearing.

8. The turbomachine of claim 1, further comprising a thrust bearing positioned adjacent the hub of at least one blade of the plurality of blades.

9. The turbomachine of claim 8, wherein the thrust bearing engages a static portion of the turbomachine when the rotor moves in an axial direction during operation.

10. The turbomachine of claim 1, wherein the housing surrounds at least one of a fan section, a compressor section and a turbine section.

11. The turbomachine of claim 10, wherein the exo-bearing engages between the housing and the rotor tip in the fan section, the compressor section and/or the turbine section.

12. The turbomachine of claim 10, wherein the bearing system includes an exo-bearing engaged between the housing and the rotor tip at each rotor stage.

13. The turbomachine of claim 1, further comprising an exo-bearing positioned at the tips of the blades at each stage of a rotor section.

14. A system comprising:

a turbomachine;

at least one rotor having a plurality of aerodynamic blades extending from a hub to a tip;

an outer static structure positioned around the at least one rotor;

an exo-bearing system positioned between the tip of the plurality of blades and the static structure; and wherein the exo-bearing system receives the entire loading from the rotor and transmits the loads from blades and into the outer static structure.

15. The system of claim 14, wherein the exo-bearing includes an inner race and an outer race.

16. The system of claim 15, wherein the outer race includes a bearing assembly fixed to the static structure and movably engageable with the inner race.

17. The system of claim 15, wherein the inner race is coupled to the tips of the blades.

18. The system of claim 15, wherein the inner race is a 360 degree rim having a bearing surface that is rotatable with the blades.

19. The system of claim 15, wherein the inner race includes a bearing assembly connected to the tips of the blades that moveably engages the outer race as the rotor rotates during operation.

20. A method comprising:

positioning an exo-bearing system between a tip of each of a plurality of blades extending radially outward on a rotor and a surrounding static structure in a turbomachine;

rotating the rotor to an operational speed; and loading the plurality of blades in compression against the exo-bearing at the operational speed; and transmitting rotor loads from the blades through the exo-bearing system and into the surrounding static structure.

* * * * *